US009027180B2

(12) United States Patent
Troutman

(10) Patent No.: US 9,027,180 B2
(45) **Date of Patent: *May 12, 2015**

(54) PLAY YARDS AND METHODS OF OPERATING THE SAME

(71) Applicant: Kolcraft Enterprises, Inc., Chicago, IL (US)

(72) Inventor: Damon Oliver Casati Troutman, Lake Forest, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/947,864

(22) Filed: Jul. 22, 2013

(65) Prior Publication Data

US 2013/0298326 A1 Nov. 14, 2013

Related U.S. Application Data

(63) Continuation of application No. 12/494,932, filed on Jun. 30, 2009, now Pat. No. 8,490,227, which is a continuation of application No. 11/063,811, filed on Feb. 23, 2005, now Pat. No. 7,568,242.

(51) Int. Cl.
*A47D 13/06* (2006.01)

(52) U.S. Cl.
CPC ..... *A47D 13/061* (2013.01); *A47D 13/063* (2013.01); *A47D 13/066* (2013.01)

(58) Field of Classification Search
CPC .. A47D 13/061; A47D 13/063; A47D 13/066
USPC ..... 5/98.1, 99.1, 93.1, 93.2, 97, 406, 407, 5/402, 403; 297/440.11, 452.63, 452.13, 297/452.12
See application file for complete search history.

(56) References Cited

U.S. PATENT DOCUMENTS

| | | | |
|---|---|---|---|
| 548,901 | A | 10/1895 | Welch |
| 607,096 | A | 7/1898 | Thacher |
| 633,353 | A | 9/1899 | Bacon |
| 914,309 | A | 3/1909 | Ross |

(Continued)

FOREIGN PATENT DOCUMENTS

AU 715883 2/2000

OTHER PUBLICATIONS

Office Action, issued by the United States Patent and Trademark Office on Dec. 19, 2006, in connection with U.S. Appl. No. 11/101,822, 6 pages.

(Continued)

*Primary Examiner* — Michael Trettel
(74) *Attorney, Agent, or Firm* — Hanley, Flight & Zimmerman, LLC

(57) ABSTRACT

Play yards and methods of operating the same are disclosed. A disclosed example includes a collapsible upper frame, a collapsible lower frame, and posts to support the upper frame above the lower frame. The posts include respective tracks. The example also includes a foldable, frameless enclosure operatively coupled to the upper frame, the lower frame and the posts. The enclosure has a plurality of sides and a bottom to define an enclosure volume. The enclosure also has a plurality of corner beads dimensioned for receipt in a respective one of the tracks to secure the enclosure to the posts.

18 Claims, 7 Drawing Sheets

(56) References Cited

U.S. PATENT DOCUMENTS 929,792 A 8/1909 Seifert
1,183,819 A 5/1916 Keiser
1,187,845 A 6/1916 Kolb
1,374,333 A 4/1921 Stotler et al.
1,407,681 A 2/1922 Saunders
1,499,821 A 7/1924 Griffiths
1,839,580 A 5/1926 Myron
1,757,241 A 12/1926 Forse
1,669,484 A 5/1928 Mowry
1,695,571 A 12/1928 Baxter
1,753,875 A 4/1930 Baumann
1,975,332 A 10/1934 Rehkoff
2,015,280 A 9/1935 Buichi
2,194,320 A 1/1939 Pearson
2,245,961 A 10/1940 Clay
2,287,907 A 6/1942 Schettler, Jr.
2,420,898 A 6/1945 Miner
2,508,506 A 12/1946 Fridolph
2,415,186 A 2/1947 Moore
2,590,315 A 12/1948 Hawley, Jr.
D158,030 S 4/1950 Wagner
2,566,594 A 5/1950 Brown
2,617,999 A 11/1952 Mitchell
2,784,420 A 10/1953 Moltane
2,698,443 A 1/1955 Ralick
D181,893 S 1/1956 Bargen
2,790,184 A 4/1957 Testa
2,790,978 A 5/1957 Tigrett
2,986,150 A 3/1958 Torian
2,873,458 A 2/1959 Adamson
2,992,441 A 3/1959 Landry
2,895,717 A 7/1959 Falco
3,012,254 A 1/1960 Hamilton
3,044,078 A 1/1960 Hamilton
3,018,493 A 1/1962 Wittbrodt
RE25,195 E 7/1962 Hamilton
3,064,277 A 11/1962 Gill
3,092,847 A 6/1963 Puy
3,095,583 A 7/1963 Golub et al.
3,103,670 A 9/1963 Landry
3,120,368 A 2/1964 Crisp
3,158,876 A 12/1964 Gottlieb
3,162,865 A 12/1964 Tigrett
3,165,760 A 1/1965 Abajian
3,183,528 A 5/1965 Jacobs et al.
3,187,352 A 6/1965 Gottlieb
3,222,841 A 12/1965 Lipof
3,233,254 A 2/1966 Golub et al.
3,289,986 A 12/1966 Martin
3,358,725 A 12/1967 Bussard et al.
3,546,721 A 12/1970 Clearly
3,640,576 A 2/1972 Morrison et al.
3,706,105 A 12/1972 Nicholson
3,763,507 A 10/1973 Propst
3,837,019 A 9/1974 Hoff
3,875,623 A 4/1975 Johnston
3,886,607 A 6/1975 Dunn
3,996,650 A 12/1976 Tonn
4,008,497 A 2/1977 Badon
D244,890 S 7/1977 Adams
4,103,401 A 8/1978 Conley
4,186,454 A 2/1980 Cone
D257,299 S 10/1980 Cone
4,302,048 A 11/1981 Yount
4,376,318 A 3/1983 Cirillo
4,538,309 A 9/1985 Gunter
4,561,138 A 12/1985 Hwang
4,576,364 A 3/1986 O'Fearna
4,631,786 A 12/1986 Curry
4,651,367 A 3/1987 Osher et al.
4,819,285 A 4/1989 Fetters
4,878,322 A 11/1989 Ikeda et al.
4,899,496 A 2/1990 Chew, II
4,900,011 A 2/1990 Nolet
4,985,948 A * 1/1991 Mariol ..... 5/99.1
5,042,769 A 8/1991 Smed
5,140,718 A 8/1992 Toth
5,172,435 A 12/1992 Griffin et al.
5,197,154 A 3/1993 Shamie
5,211,498 A 5/1993 Huang
5,239,714 A 8/1993 Huang
D339,922 S 10/1993 Williams
D340,598 S 10/1993 Castiglioni et al.
5,274,863 A 1/1994 Fountain
5,279,006 A 1/1994 Teng
5,307,531 A 5/1994 Kao
5,335,685 A 8/1994 Dahulich
5,339,470 A 8/1994 Shamie
5,349,709 A 9/1994 Cheng
5,367,725 A 11/1994 Tsai
5,381,570 A 1/1995 Cheng
5,414,873 A 5/1995 Wolf
5,450,703 A 9/1995 Fuhrman et al.
5,504,951 A 4/1996 Yeh
5,513,399 A 5/1996 Weng
5,517,707 A 5/1996 LaMantia
5,526,542 A 6/1996 Huang
5,533,715 A 7/1996 Dandrea
5,545,151 A 8/1996 O'Connor et al.
5,553,336 A 9/1996 Mariol
5,560,055 A 10/1996 Ziegler
D375,217 S 11/1996 Rehmert
5,581,827 A * 12/1996 Fong et al. ..... 5/98.1
5,615,427 A 4/1997 Huang
D382,718 S 8/1997 Mariol
5,716,101 A 2/1998 Frinier et al.
5,722,477 A 3/1998 Richter et al.
5,752,297 A 5/1998 Ramey
5,758,868 A 6/1998 Shea
5,761,755 A 6/1998 Huang
5,762,403 A 6/1998 Robinson
5,778,465 A 7/1998 Myers
D397,882 S 9/1998 Wu
5,826,285 A 10/1998 Mariol et al.
5,845,349 A 12/1998 Tharalson et al.
5,867,850 A 2/1999 Mariol
5,867,851 A 2/1999 Mariol et al.
5,878,802 A 3/1999 Richter et al.
D409,411 S 5/1999 Mariol et al.
D411,386 S 6/1999 Horn
D413,025 S 8/1999 Mariol et al.
5,991,944 A 11/1999 Yang
5,992,348 A 11/1999 Harding
6,041,455 A 3/2000 Raffo et al.
6,067,676 A 5/2000 Carnahan et al.
6,098,217 A 8/2000 Hammil
6,123,321 A 9/2000 Miller
6,148,488 A 11/2000 Gristock
6,173,462 B1 1/2001 Huang
6,192,535 B1 2/2001 Warner et al.
6,221,036 B1 4/2001 Lucas
6,233,759 B1 5/2001 Warner
6,250,837 B1 6/2001 Mariol et al.
6,256,814 B1 7/2001 Drobinski
D448,218 S 9/2001 Celestina-Krevh
6,293,624 B1 9/2001 Gaylord et al.
6,317,907 B1 11/2001 Wang
6,332,231 B1 12/2001 Wang
6,385,800 B1 5/2002 Chen et al.
D461,645 S 8/2002 Hartenstine et al.
6,434,767 B1 8/2002 Welsh, Jr.
6,510,570 B2 1/2003 Hartenstine et al.
6,539,563 B1 4/2003 Hsia
6,543,070 B2 4/2003 Longenecker et al.
6,560,827 B1 5/2003 Gross
6,578,211 B2 6/2003 Tharalson et al.
6,615,424 B1 9/2003 Chen et al.
6,665,895 B1 12/2003 St. Pierre et al.
6,721,971 B1 4/2004 Cheng
D494,393 S 8/2004 Chen
D500,213 S 12/2004 DeHart et al.
6,859,957 B1 * 3/2005 Chen ..... 5/93.1
6,859,958 B2 3/2005 LaMantia
6,874,177 B2 4/2005 Hsia

(56) References Cited

U.S. PATENT DOCUMENTS

| | | | | |
|---|---|---|---|---|
| 6,895,611 | B2 | 5/2005 | Tharalson et al. | |
| 6,948,197 | B1 | 9/2005 | Chen | |
| 6,954,949 | B1 | 10/2005 | Chen | |
| 6,959,462 | B2 | 11/2005 | Chen | |
| 7,003,382 | B2 | 2/2006 | Honda | |
| 7,003,821 | B2 | 2/2006 | De Hart et al. | |
| 7,013,505 | B2 | 3/2006 | Martin | |
| 7,020,914 | B2 | 4/2006 | Miyakawa | |
| 7,043,779 | B2 | 5/2006 | Mendenhall et al. | |
| 7,055,192 | B2 | 6/2006 | Waters et al. | |
| 7,090,201 | B2 | 8/2006 | Brucker | |
| 7,100,625 | B2 | 9/2006 | Valles | |
| D534,381 | S | 1/2007 | Troutman et al. | |
| D537,277 | S | 2/2007 | Chen | |
| D557,510 | S | 12/2007 | Troutman | |
| D566,998 | S | 4/2008 | Troutman | |
| D570,621 | S | 6/2008 | Troutman et al. | |
| 7,458,114 | B2 | 12/2008 | Troutman | |
| 7,568,242 | B2 * | 8/2009 | Troutman | 5/99.1 |
| 7,568,243 | B2 | 8/2009 | Gehr et al. | |
| D604,970 | S | 12/2009 | Troutman et al. | |
| D616,231 | S | 5/2010 | Troutman et al. | |
| D616,677 | S | 6/2010 | Troutman et al. | |
| RE43,919 | E | 1/2013 | Chen | |
| 8,490,227 | B2 * | 7/2013 | Troutman | 5/99.1 |
| 2003/0154547 | A1 | 8/2003 | Hsia | |
| 2003/0177575 | A1 | 9/2003 | Cheng et al. | |
| 2004/0261174 | A1 | 12/2004 | DeHart et al. | |
| 2005/0144716 | A1 | 7/2005 | Chen | |
| 2005/0144717 | A1 | 7/2005 | Chen | |
| 2005/0144718 | A1 | 7/2005 | Miyakawa | |
| 2005/0229308 | A1 | 10/2005 | Chen | |
| 2006/0037137 | A1 | 2/2006 | Song | |
| 2006/0225207 | A1 | 10/2006 | Johnson | |
| 2006/0230528 | A1 * | 10/2006 | Church | 5/98.1 |

OTHER PUBLICATIONS

Office Action, issued by the United States Patent and Trademark Office on Apr. 9, 2007, in connection with U.S. Appl. No. 11/101,822, 5 pages.

Office Action, issued by the United States Patent and Trademark Office on Nov. 2, 2007, in connection with U.S. Appl. No. 11/101,822, 7 pages.

Notice of Allowance and Fee(s) Due, issued by the United States Patent and Trademark Office on Jul. 31, 2008, in connection with U.S. Appl. No. 11/101,822, 4 pages.

Office Action, issued by the United States Patent and Trademark Office on Aug. 21, 2006, in connection with U.S. Appl. No. 11/063,811, 19 pages.

Office Action, issued by the United States Patent and Trademark Office on Jun. 5, 2007, in connection with U.S. Appl. No. 11/063,811, 13 pages.

Office Action, issued by the United States Patent and Trademark Office on Mar. 5, 2008, in connection with U.S. Appl. No. 11/063,811, 16 pages.

Office Action, issued by the United States Patent and Trademark Office on Oct. 30, 2008, in connection with U.S. Appl. No. 11/063,811, 13 pages.

Notice of Allowance and Fee(s) Due, issued by the United States Patent and Trademark Office on Apr. 16, 2009, in connection with U.S. Appl. No. 11/063,811, 7 pages.

Office Action, issued by the United States Patent and Trademark Office on Dec. 29, 2006, in connection with U.S. Appl. No. 11/101,821, 5 pages.

Office Action, issued by the United States Patent and Trademark Office on May 22, 2007, in connection with U.S. Appl. No. 11/101,821, 13 pages.

Office Action, issued by the United States Patent and Trademark Office on Jan. 23, 2008, in connection with U.S. Appl. No. 11/101,821, 16 pages.

Office Action, issued by the United States Patent and Trademark Office on Feb. 4, 2008, in connection with U.S. Appl. No. 11/101,821, 16 pages.

Office Action, issued by the United States Patent and Trademark Office on Nov. 23, 2005, in connection with U.S. Appl. No. 29/216,626, 6 pages.

Office Action, issued by the United States Patent and Trademark Office on Apr. 21, 2006, in connection with U.S. Appl. No. 29/216,626, 7 pages.

Office Action, issued by the United States Patent and Trademark Office on Nov. 14, 2005, in connection with U.S. Appl. No. 29/216,576, 4 pages.

Notice of Allowance and Fee(s) Due, issued by the United States Patent and Trademark Office on Feb. 2, 2006, in connection with U.S. Appl. No. 29/216,576, 6 pages.

Notice of Allowance and Fee(s) Due, issued by the United States Patent and Trademark Office on Dec. 28, 2007, in connection with U.S. Appl. No. 29/216,576, 13 pages.

Notice of Allowance and Fee(s) Due, issued by the United States Patent and Trademark Office on Mar. 1, 2006, in connection with U.S. Appl. No. 29/244,887, 5 pages.

Notice of Allowance and Fee(s) Due, issued by the United States Patent and Trademark Office on Sep. 26, 2007, in connection with U.S. Appl. No. 29/244,887, 5 pages.

Supplemental Notice of Allowance and Fee(s) Due, issued by the United States Patent and Trademark Office on Oct. 19, 2007, in connection with U.S. Appl. No. 29/244,887, 2 pages.

Office Action, issued by the United States Patent and Trademark Office on Nov. 14, 2005, in connection with U.S. Appl. No. 29/216,591, 4 pages.

Office Action, issued by the United States Patent and Trademark Office on Jan. 30, 2006, in connection with U.S. Appl. No. 29/216,591, 4 pages.

Notice of Allowance and Fee(s) Due, issued by the United States Patent and Trademark Office on Aug. 22, 2006, in connection with U.S. Appl. No. 29/216,591, 5 pages.

Office Action, issued by the United States Patent and Trademark Office on Mar. 2, 2006, in connection with U.S. Appl. No. 29/244,886, 7 pages.

Office Action, issued by the United States Patent and Trademark Office on Jun. 27, 2006, in connection with U.S. Appl. No. 29/244,886, 5 pages.

Office Action, issued by the United States Patent and Trademark Office on Jan. 26, 2007, in connection with U.S. Appl. No. 29/244,886, 5 pages.

Office Action, issued by the United States Patent and Trademark Office on Nov. 20, 2007, in connection with U.S. Appl. No. 29/244,886, 5 pages.

Notice of Allowance and Fee(s) Due, issued by the United States Patent and Trademark Office on Apr. 11, 2008, in connection with U.S. Appl. No. 29/244,886, 5 pages.

Supplemental Notice of Allowance and Fee(s) Due, issued by the United States Patent and Trademark Office on Apr. 24, 2008, in connection with U.S. Appl. No. 29/244,886, 2 pages.

Office Action, issued by the United States Patent and Trademark Office on Mar. 2, 2006, in connection with U.S. Appl. No. 29/244,885, 5 pages.

Office Action, issued by the United States Patent and Trademark Office on Jun. 28, 2006, in connection with U.S. Appl. No. 29/244,885, 5 pages.

Office Action, issued by the United States Patent and Trademark Office on Jan. 26, 2007, in connection with U.S. Appl. No. 29/244,885, 7 pages.

Examiner's Answer, issued by the United States Patent and Trademark Office on Nov. 20, 2007, in connection with U.S. Appl. No. 29/244,885, 10 pages.

Decision on Appeal, issued by the United States Patent and Trademark Office on Sep. 25, 2009, in connection with U.S. Appl. No. 29/244,885, 12 pages.

Notice of Allowance and Fee(s) Due, issued by the United States Patent and Trademark Office on Oct. 5, 2009, in connection with U.S. Appl. No. 29/244,885, 6 pages.

(56) References Cited

OTHER PUBLICATIONS

Office Action, issued by the United States Patent and Trademark Office on Oct. 13, 2009, in connection with U.S. Appl. No. 29/339,831, 23 pages.
Notice of Allowance and Fee(s) Due, issued by the United States Patent and Trademark Office on Mar. 10, 2010, in connection with U.S. Appl. No. 29/339,831, 5 pages.
Office Action, issued by the United States Patent and Trademark Office on Oct. 13, 2009, in connection with U.S. Appl. No. 29/339,833, 20 pages.
Notice of Allowance and Fee(s) Due, issued by the United States Patent and Trademark Office on Feb. 24, 2010, in connection with U.S. Appl. No. 29/339,833, 4 pages.
Office Action, issued by the United States Patent and Trademark Office on Nov. 17, 2009, in connection with U.S. Appl. No. 12/494,932, 22 pages.
Office Action, issued by the United States Patent and Trademark Office on Jun. 23, 2010, in connection with U.S. Appl. No. 12/494,932, 16 pages.
Office Action, issued by the United States Patent and Trademark Office on Feb. 15, 2011, in connection with U.S. Appl. No. 12/494,932, 7 pages.
Office Action, issued by the United States Patent and Trademark Office on Sep. 2, 2011, in connection with U.S. Appl. No. 12/494,932, 16 pages.
Office Action, issued by the United States Patent and Trademark Office on Feb. 6, 2012, in connection with U.S. Appl. No. 12/494,932, 18 pages.
Office Action, issued by the United States Patent and Trademark Office on May 21, 2012, in connection with U.S. Appl. No. 12/494,932, 15 pages.
Advisory Action, issued by the United States Patent and Trademark Office on Aug. 24, 2012, in connection with U.S. Appl. No. 12/494,932, 4 pages.
Notice of Allowance, issued by the United States Patent and Trademark Office on Mar. 25, 2013, in connection with U.S. Appl. No. 12/494,932, 17 pages.
Century Products Co. Instruction Manuel, "Fold-n-Go Care Center," 12 pages.
Jackson, Albert and David Day, *Good Wood Joints*, Popular Woodworking Books, F&W Publications, Inc., Cincinnati, OH, 1995, p. 11, ISBN 1-55870-539-2.
Trialanderror, "Round Mortise and Tenons," Feb. 20, 2012, available at http://trialanderrorwoodworker.wordpress.com/2012/02/20/round-mortice-and-tenons/, accessed on Sep. 22, 2014, 2 pages.
Applicant's Admitted Prior Art document, filed herewith.

* cited by examiner

PLAY YARDS AND METHODS OF OPERATING THE SAME

RELATED APPLICATIONS

This patent arises from a continuation of U.S. patent application Ser. No. 12/494,932 (now U.S. Pat. No. 8,490,227), which was filed on Jun. 30, 2009, which is a continuation of U.S. patent application Ser. No. 11/063,811 (now U.S. Pat. No. 7,568,242), which was filed on Feb. 23, 2005. Priority to both U.S. patent application Ser. Nos. 12/494,932 and 11/063,811 is claimed. Both U.S. patent application Ser. Nos. 12/494,932 and 11/063,811 are hereby incorporated by reference in their entireties.

FIELD OF THE DISCLOSURE

This disclosure relates generally to childcare products, and, more particularly, to play yards and methods of operating the same.

BACKGROUND

In recent years, portable play yards have become very popular. Portable play yards typically include a frame, a flexible enclosure supported by the frame, and a removable floor board or mat. The frame is largely or completely contained within the flexible enclosure so that there are few if any loose parts when the frame is collapsed or when the frame is erected. When collapsed, the portable play yard typically has a compact form factor to enable easy transport and storage of the play yard. Sometimes, the floorboard is wrapped around the collapsed frame to prevent the frame from inadvertently leaving the collapsed state.

DETAILED DESCRIPTION

Figure 1:
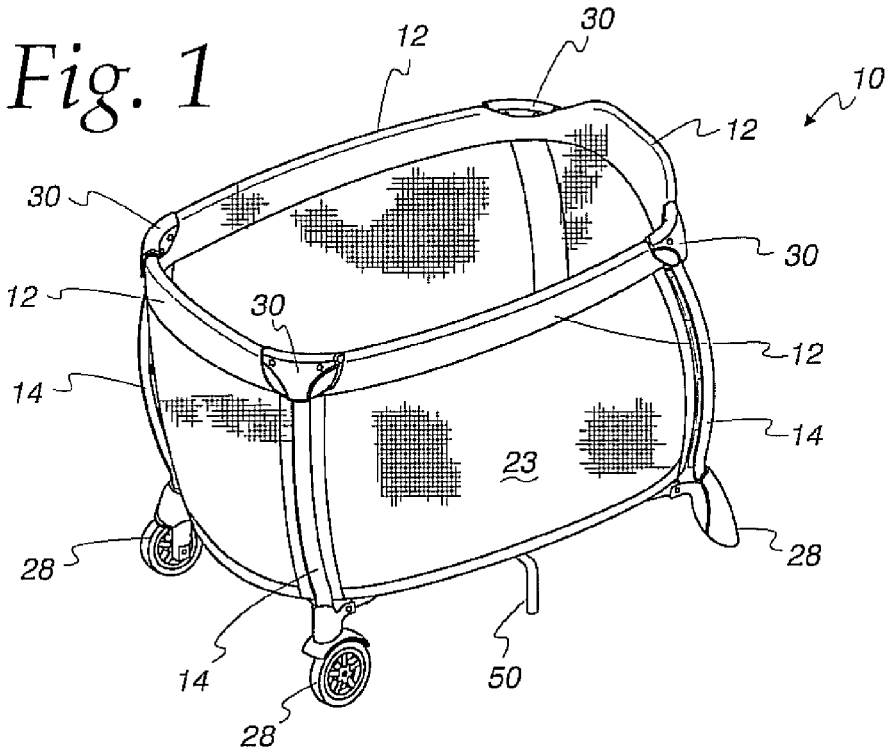
FIG. 1 is a perspective view of an example play yard constructed in accordance with the teachings of the invention.

An example play yard 10 is shown in FIG. 1. The play yard 10 is portable in that it is intended to be collapsible from an erected position such as the example position shown in FIG. 1 to a collapsed position such as the example position illustrated in FIGS. 6-7. When the play yard 10 is in the erected position, it provides an enclosure for a small child or infant. The play yard 10 has a smaller form factor when it is in the collapsed position then when it is in the erected position. Therefore, the play yard 10 may be easily stored or transported when collapsed.

As shown in FIG. 1, when in the erected position, the illustrated play yard 10 has a rounded rectangular shape. In particular, the illustrated play yard 10 has four sides 12, each of which is bowed outward away from the center of the play yard 10. In addition, the play yard 10 of FIG. 1 includes four corner posts 14 joining the sides 12 that define the rounded rectangular shape. Like the sides 12, the corner posts 14 are bowed outward away from the center of the play yard 10. However, whereas the sides 12 bow about a generally vertical axis, the corner posts 14 curve about a generally horizontal axis. As a result of the bowed sides 12 and corner posts 14, the play yard 10 defines a rounded rectangular volume.

Figure 2:
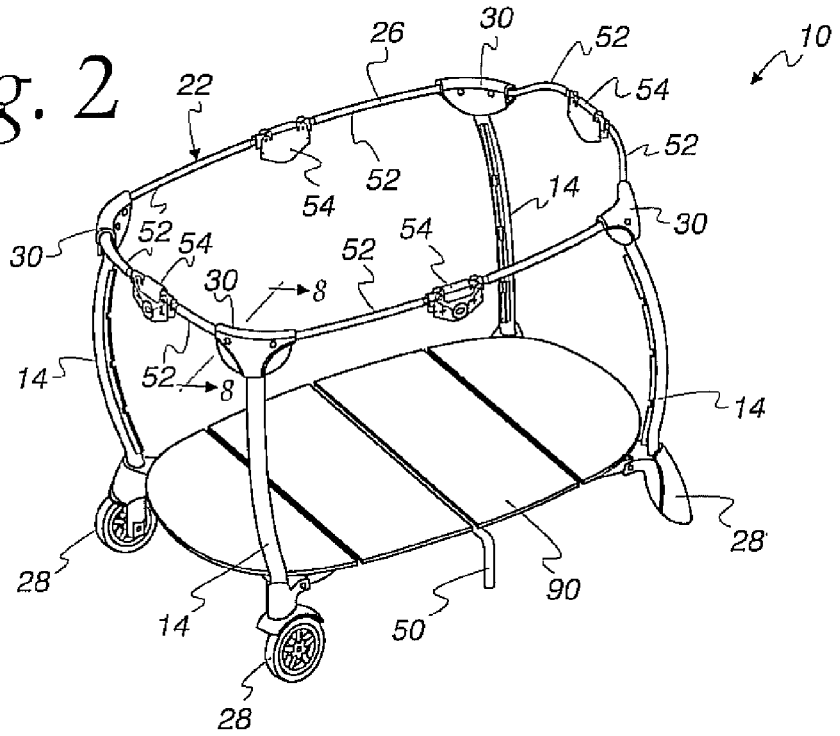
FIG. 2 is a perspective view of the example play yard of FIG. 1 shown without the enclosure.
Figure 3:
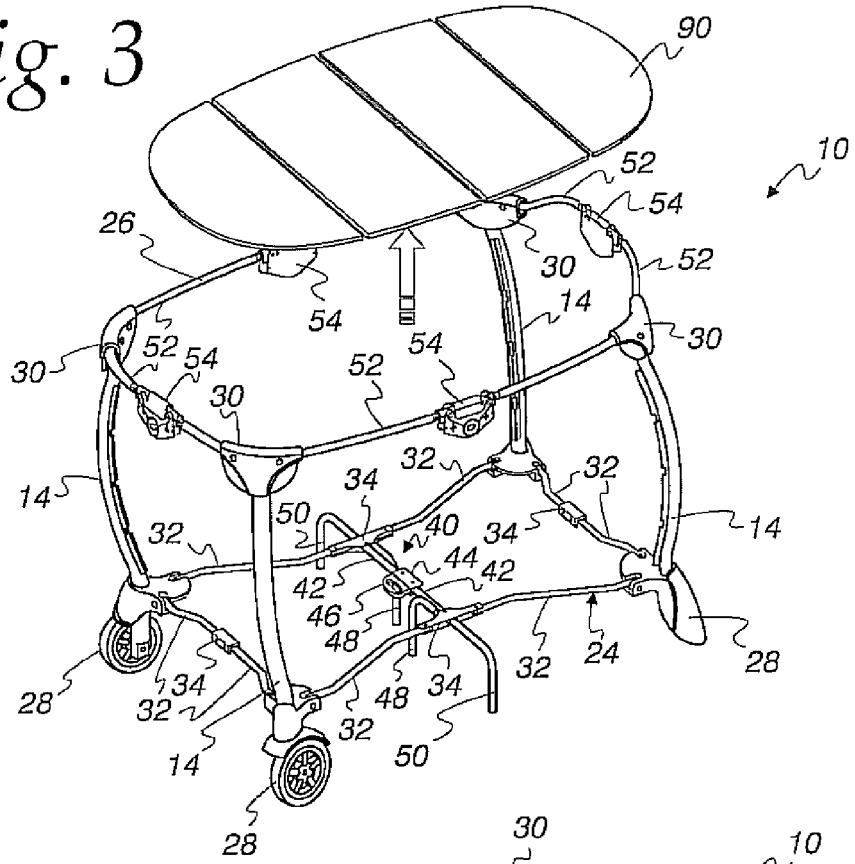
FIG. 3 illustrates the example play yard of FIG. 1 with the removable floor board raised to expose the lower frame.

The illustrated portable play yard 10 includes a frame 22 (see FIGS. 2 and 3) and an enclosure 23 supported on the frame 22. The frame 22 includes a collapsible lower frame 24 (see FIG. 3) and a collapsible upper frame 26 (see FIG. 2). The upper frame 26 is suspended above the lower frame 24 by the corner posts 14. Each of the corner posts 14 is connected between a foot 28 and an end cap or bracket 30. Each foot 28 is coupled to the lower frame 24. Each end cap 30 is coupled to the upper frame 26.

As shown in FIG. 1, in the illustrated play yard 10 two of the feet are implemented as conventional wheels and two of the feet 28 are implemented as stationary supports to facilitate movement of the erected play yard 10 when desired and to prevent unwanted rolling of the play yard 10 when movement is not desired. However, persons of ordinary skill in the art will appreciate that a different number of feet 28 (e.g., 0, 1, etc.) may be implemented by wheels and/or stationary supports, if desired.

Figure 4:
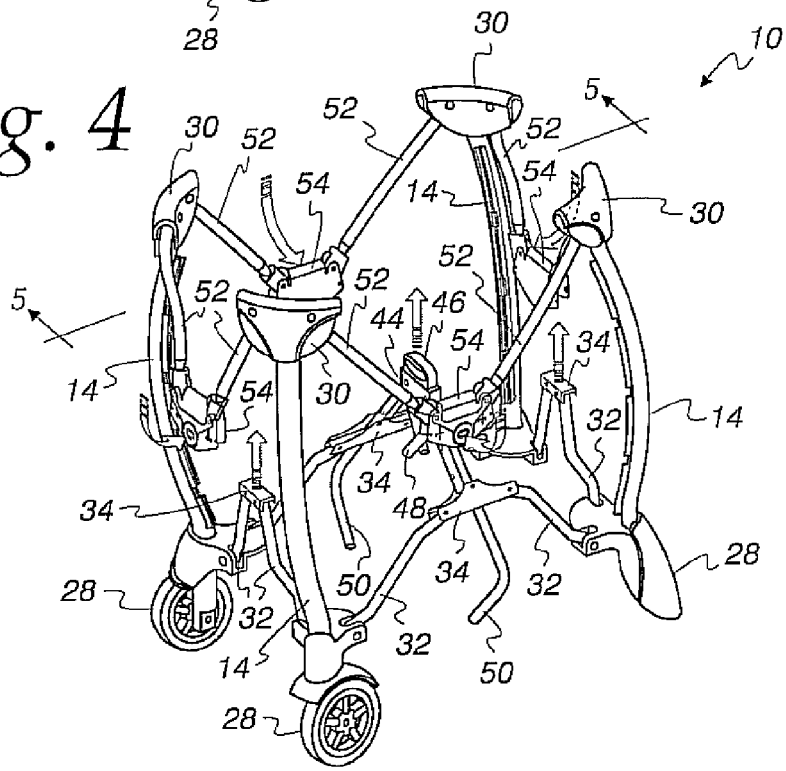
FIG. 4 illustrates the example play yard of FIG. 1 in a semi-folded state with arrows indicating the direction in which the joints of the frame of the play yard move to collapse the play yard.
Figure 5:
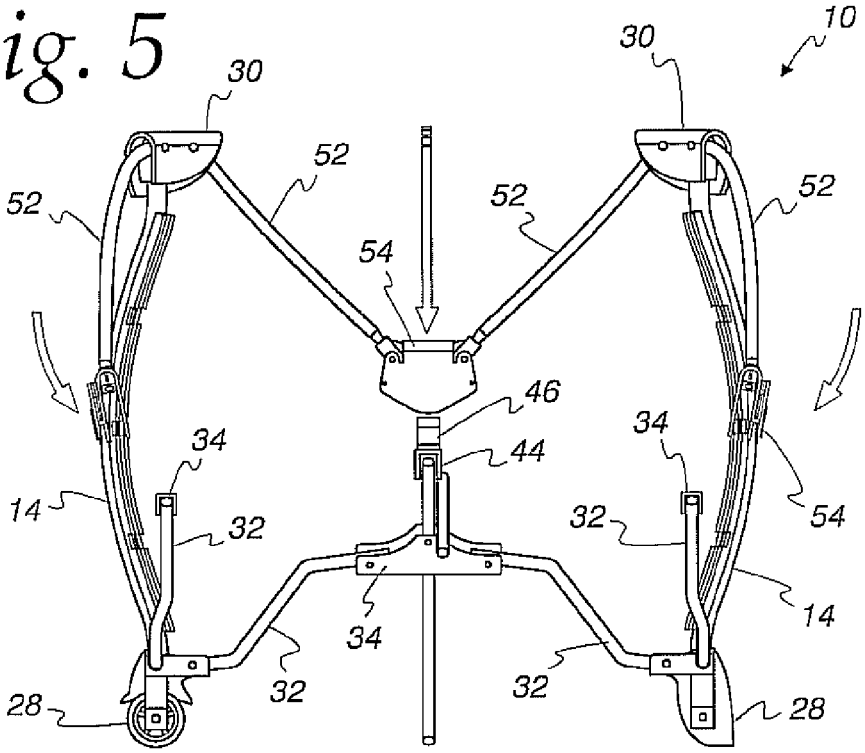
FIG. 5 is a side view of the example play yard of FIG. 1 in a semi-folded state.

The lower frame 24 of the illustrated play yard 10 includes four outer sides which, when the lower frame is in the erected position, together define a generally rectangular perimeter. Each of the outer sides comprises a pair of rails 32 joined by a central joint 34. One end of each of the rails 32 is pivotably coupled to one of the feet 28. The opposite end of each of the rails 32 is pivotably coupled to one of the central joints 34. The pivotable couplings enable the sides of the lower frame 24 to be moved between the erected position and the collapsed position. As shown in FIGS. 4 and 5, the joints 34 move upward and translate inward when the play yard 10 is moved from the erected position to the collapsed position.

For the purpose of selectively locking the lower frame 24 in the erected position and for providing support for the center of the play yard 10, the lower frame 10 is further provided with a central assembly 40. The central assembly 40 is pivotably coupled to the central joints 34 of two opposite sides of the lower frame 24. More specifically, the central assembly 40 includes two rails 42 and a central hinge 44. In the illustrated example, one end of each rail 42 is pivotably coupled to a respective one of the central joints 34 of the long sides of the play yard 10. The opposite ends of the rails 42 are coupled to the central hinge 44 of the central assembly 40.

The central hinge 44 includes a conventional lock mechanism to selectively permit or prevent movement of the central assembly 40 and, thus, the lower frame assembly 24 from the erected position to the collapsed position. The lock mechanism comprises a handle 46. When the handle 46 is pivoted into a generally horizontal position (see FIG. 3), a sleeve associated with the handle 46 substantially prevents the rails 42 of the central assembly 40 from pivoting upward. As a result, the central assembly 40 and, thus, the lower frame 24 cannot be collapsed. When the handle 46 is pivoted into a generally vertical position (See FIG. 4), the sleeve associated with the handle 46 does not prevent the rails 44 of the central assembly 40 from pivoting upward. As a result, the central assembly 40 and, thus, the lower frame 24 may be collapsed by lifting the handle 46.

To provide support for the center of the play yard floor when the play yard 10 is in the erected position, the central assembly 40 includes a pair of centrally located feet 48. To provide further lateral support for the lower frame 24, a pair of opposed outrigger feet 50 are coupled to opposed ones of the central hinges 34 (see FIGS. 3 and 4). Like the feet 28, the outrigger feet 50 and the centrally located feet 48 are positioned to engage a ground surface supporting the play yard 10 when the play yard 10 is in the erected position.

The upper frame 26 of the illustrated play yard 10 includes four outer sides which, when the upper frame 26 is in the erected position, together define a rounded rectangular (i.e., four sided) perimeter. The rounded rectangular shape may be an oval, a half-oval, or any combination of rounded and straight sides. However, at least one of the sides is preferably rounded. It is even more preferable that at least two opposite sides are rounded to provide symmetry.

In the illustrated example, each of the outer sides comprises a pair of outwardly bowed rails 52 joined by a central joint 54. One end of each of the rails 52 is pivotably coupled to one of the end caps 30. The opposite end of each of the rails 52 is pivotably coupled to one of the central joints 54. The pivotable couplings enable the sides of the upper frame 26 to be moved between the erected position and the collapsed position.

Each of the central joints 54 is provided with a releasable lock to enable selective collapsing of the upper frame 26. The construction of the releasable lock forms no part of the present invention and will not be discussed in detail here. Persons of ordinary skill in the art are aware of the numerous types of joint locks that are used in portable play yards. Any of those known locks may be employed in the illustrated play yard 10. For example, the releasable locks described in U.S. Pat. No. 6,250,837, which is hereby incorporated herein by reference, may be used in this role.

Figure 6:
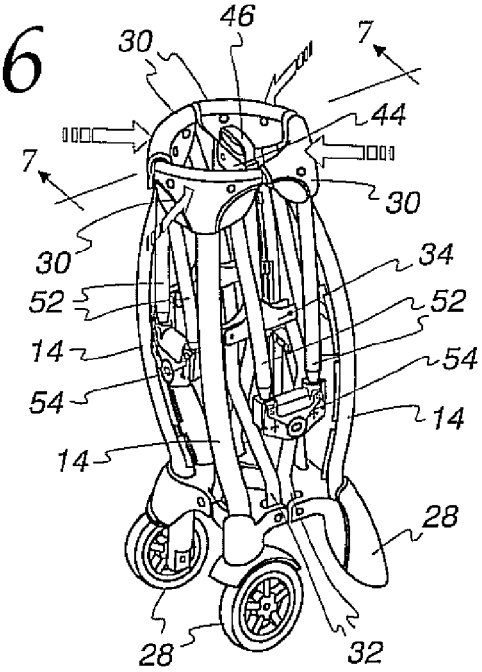
FIG. 6 is a perspective view of the example play yard of FIG. 1 in a fully folded state.
Figure 7:
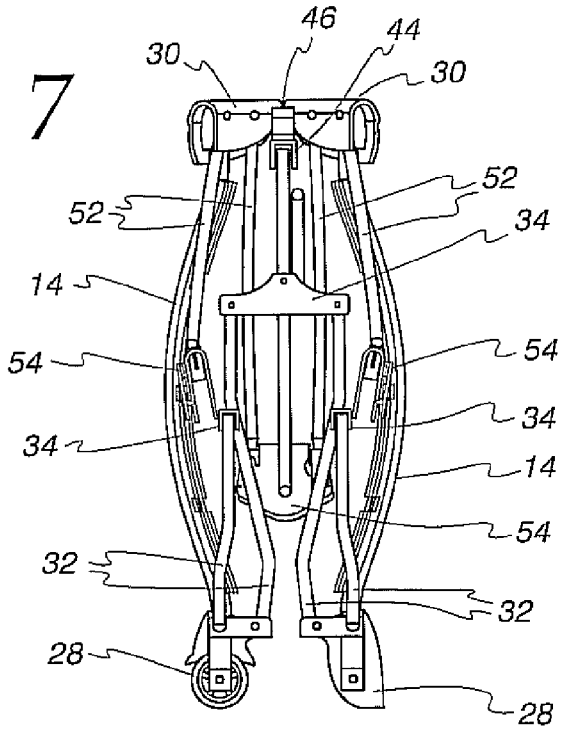
FIG. 7 is side view of the example play yard of FIG. 1 in the fully folded state.

It is desirable for the form factor of the play yard 10 to be as small as possible when the play yard 10 is folded into the collapsed position of FIG. 6. A small form factor translates into less packaging costs for the manufacturer and smaller storage requirements for the end user. Because the rails 52 of the upper frame 26 are outwardly bowed to create the rounded rectangular perimeter, the central joints 54 extend further away from the center of the play yard 10 when the upper frame 26 is in the erected position than would the central joints of a conventional rectangular frame. Therefore, if the central joints 54 are permitted to move directly downward when the upper frame 24 is moved from the erected position to the collapsed position, the joints 54 would increase the form factor of the collapsed play yard 10.

Therefore, to reduce the form factor of the collapsed play yard 10, the rails 52 of the upper frame 26 are coupled to the end caps 30 such that the centers of each side of the upper frame 26 (e.g., the central joints 54) move inward and downward as the upper frame 26 moves from the erected position to the collapsed position, as indicated by the arrows in FIGS. 4 and 5. (The inward component of this motion is in addition to the inward translation caused by moving the posts 14 toward one another as shown in FIG. 6). As a result, when the upper and lower frames 24, 26 are in the collapsed positions shown in FIG. 6, the joints 54 are positioned inward of the posts 14. Positioning the joints 54 inward of the posts 14 when the play yard 10 is in the fully collapsed position creates a smaller, more compact structure, which eases storage and transportation.

Figure 8:
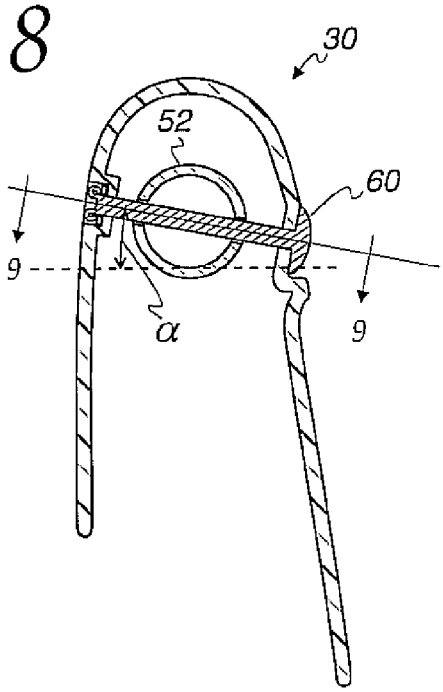
FIG. 8 is a cross-sectional view of an end cap of the example play yard taken along line 8-8 of FIG. 1 and illustrating the pivotable connection of an upper frame rail to the end cap.
Figure 9:
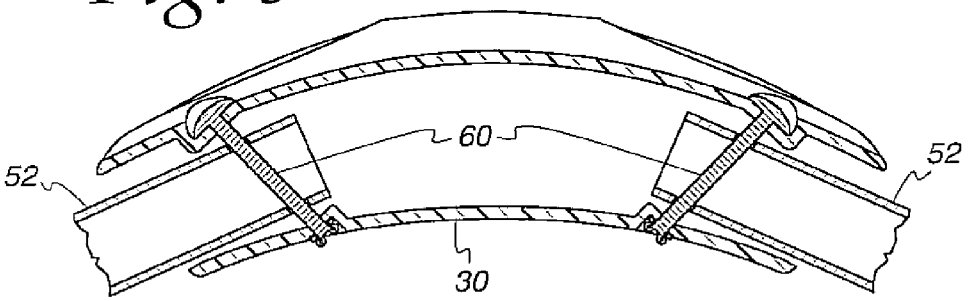
FIG. 9 is a cross-sectional view taken along line 9-9 of FIG. 8.

To produce the desired inward and downward movement of the centers of the rails 52 as the upper frame 26 is collapsed, the rails 52 of the upper frame 26 are pivotably coupled to the end caps 30 by mechanical fasteners 60 that are positioned at an angle $\alpha$ from the horizontal. In the example of FIGS. 8 and 9, each mechanical fastener 60 penetrates an end cap 30 and a corresponding one of the rails 52 of the upper frame 26. Each mechanical fastener 60, thus, defines an axis of rotation for a corresponding one of the rails 52. Selecting the angular orientation of the mechanical fasteners 60, thus selects the pivoting motion of the corresponding rails 52.

Preferably, all of the mechanical fasteners 60 are positioned at the same angle $\alpha$, but persons of ordinary skill in the art will readily appreciate that different angular orientations could optionally be used for different sides of the upper frame 26 if different pivoting motions are desired for those different sides. For example, if it is desirable to have sides that extend different distances from the center of the play yard when the play yard is erected, but which still close in to substantially the same distance from the center of the play yard when the play yard is collapsed such that the collapsed play yard has a generally rectangular form factor, the fasteners of the differently positioned sides would be positioned at different angular orientations to achieve the different movements of the differently extending sides. Similarly, in the illustrated example, the angle $\alpha$ is approximately 11 degrees from the horizontal plane, but other angles may be selected to obtain a desired movement of the centers of the rails 52. The mechanical fasteners may be implemented by bolts, screws, rivets, etc.

Figure 10:
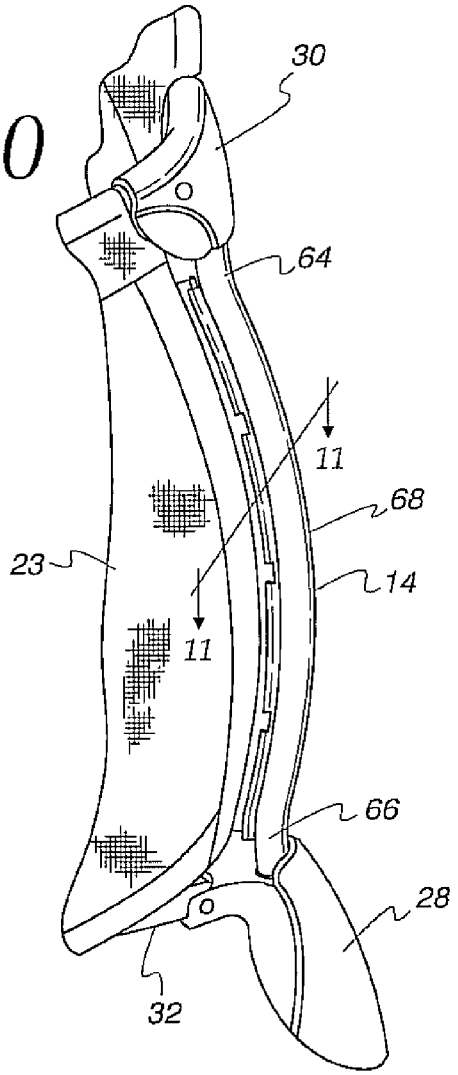
FIG. 10 is an enlarged side view of a post of the example play yard of FIG. 1.

To further enlarge the volume of the play yard 10 and to enhance its rounded appearance, the posts 14 that support the upper frame 26 above the lower frame 24 are curved. In the illustrated example, the posts 14 include a body having a generally straight upper section 64, a generally straight lower section 66, and a curved central section 68 (see FIG. 10). The upper section 64 of each post 14 is coupled to a respective one of the end caps 30 by one or more mechanical fasteners (e.g., rivets). The lower section 66 of each post 14 is coupled to a respective one of the feet 28 by one or more mechanical fasteners (e.g., rivets). Preferably, the curved section 68 of each post is oriented to bow away from the center of the play yard 10 about a generally horizontal axis. The posts 14, like the rails 32, 52 of the lower and upper frames 24, 26, may be constructed of metal (e.g., steel, aluminum, etc.) or of extruded plastic tubes.

As mentioned above, the illustrated play yard 10 includes an enclosure 23 that is supported by the frame 22. Preferably, the enclosure includes five flexible sides, namely, a bottom and four sides. The top is open. The enclosure 23 may be made of fabric, plastic, mesh and/or any other material which is sufficiently strong and durable to define the enclosure volume throughout the desired useful life of the play yard 10 and which is flexible enough to be folded. In the illustrated example, the enclosure 23 is a fabric structure including mesh side panels. The illustrated enclosure 23 includes upper sleeves which receive the rails 52 of the upper frame 26 and lower sleeves which receive the rails 32 of the lower frame 24. In other words, the sides of the enclosure 23 are stretched between the upper and lower frames 24, 26.

Unlike traditional play yards, the posts 14 are not covered or encased in the enclosure 23. Instead, the enclosure 23 of the illustrated play yard is coupled to the inner surface of the posts 14. As a result, the outward facing surfaces, (particularly of the curved sections 68), of the posts 14 are completely exposed.

Figure 11:
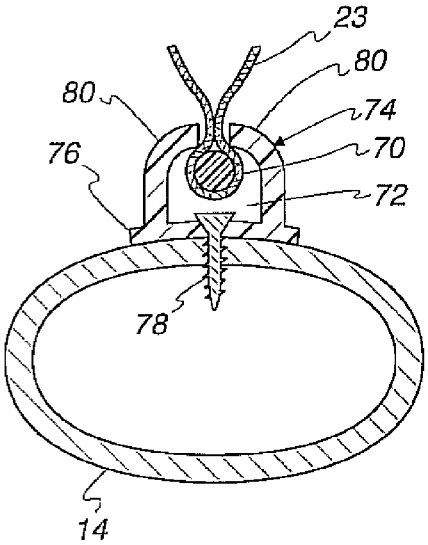
FIG. 11 is a cross-sectional view of the post taken along line 11-11 of FIG. 10.
Figure 12:
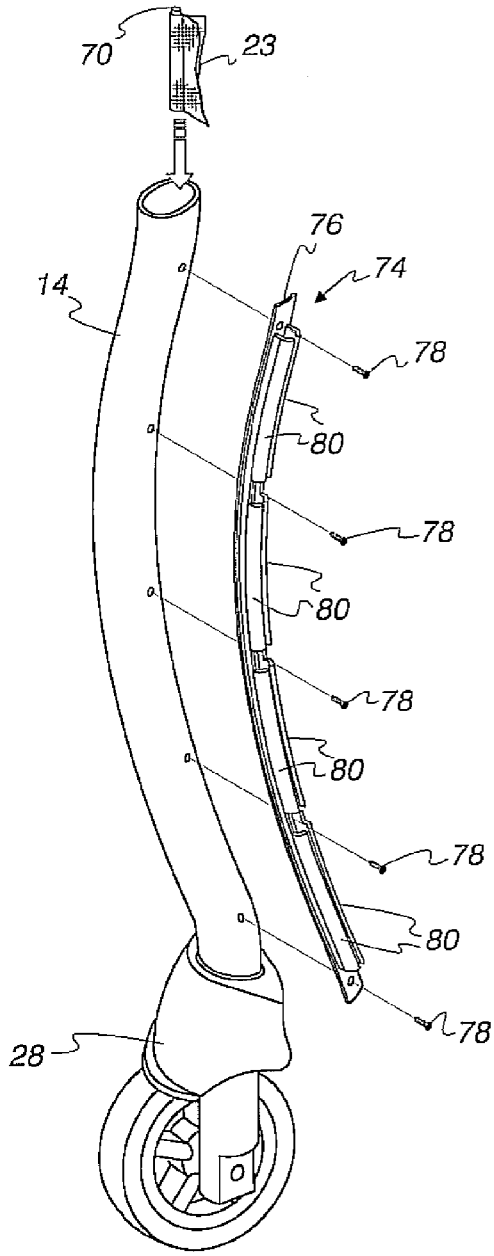
FIG. 12 is an exploded perspective view of another example post of the example play yard of FIG. 1.

In order to facilitate coupling of the enclosure 23 to the posts 14, each of the corners of the enclosure 23 is sewn, glued, fused or otherwise fastened into a sleeve which receives a flexible cylindrical member to define a corner bead 70 as shown in FIGS. 11 and 12. The flexible cylindrical member may be implemented by a wire, a rope, a foam or plastic tube, etc. Further, each post 14 defines a channel 72 for receiving a respective one of the corner beads 70.

In a presently preferred implementation, each channel 72 is defined by a track 74 which is coupled to the exterior of a respective one of the posts 14. Because the tracks 74 are coupled to the inner surfaces of the curved posts 14, the tracks 74 are curved in a manner that complements the post shape. In the example of FIGS. 11 and 12, the track 74 includes a backing 76 which is secured to a respective one of the posts 14 via mechanical fasteners 78 (e.g., rivets, screw, etc.). The channel 72 is defined adjacent the backing 76 by opposed arms 80. Each of the opposed arms 80 has a first end coupled to the backing 76 and a second free end. The free ends of the arms 80 are curved toward one another to define a slit having a width through which the corner bead 70 may not pass. In the illustrated example, four sets of opposed arms 80 are employed, but other numbers of arms 80 (e.g., 1, 2, 3, 5, etc.) might likewise be appropriately employed. The backing 76 and the arms 80 of the illustrated example are integrally formed, since the track 74 is made of molded plastic.

In the example of FIGS. 11 and 12, the tracks 74 are preferably fastened to their corresponding posts 14, and the corner beads 70 are then threaded down into the channels 74 defined by their respective tracks 74. To facilitate assembly, it may be easier to thread the corner beads 70 of the enclosure 23 into their respective channels 74 before assembling the end caps 30 and the upper frame 26 to the posts 14.

Figure 14:
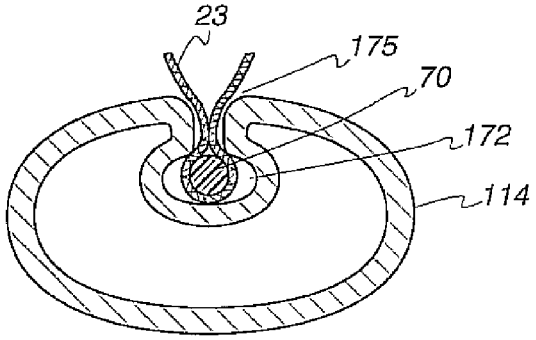
FIG. 14 is a cross-sectional view of the post taken along line 14-14 of FIG. 13*b*.
Figure 13A:
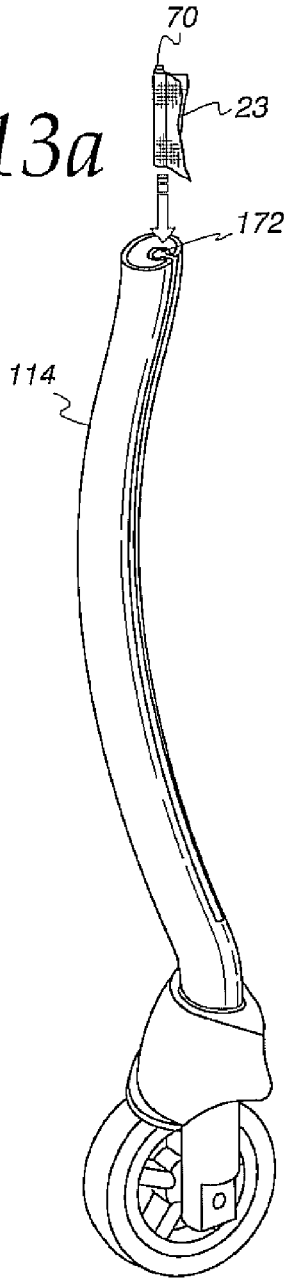
FIG. 13*a* is a perspective view of another example post that may alternatively be used with the example play yard of FIG. 1 showing the post prior to receiving the enclosure.
Figure 13B:
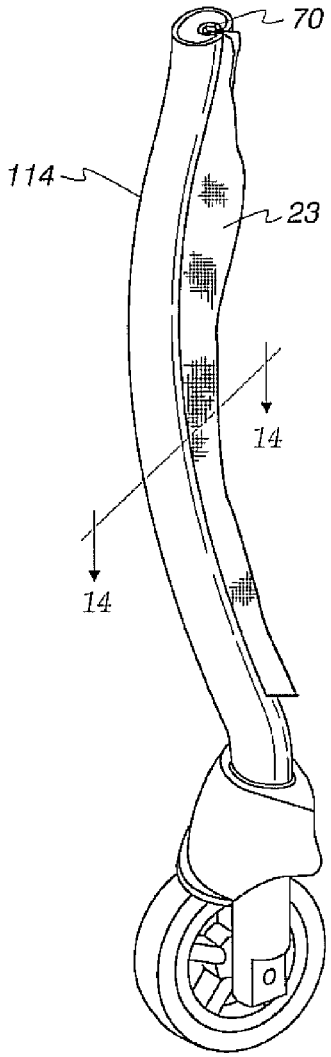
FIG. 13*b* is a perspective view similar to FIG. 13*a*, but showing the enclosure coupled to the post.

An alternative post 14 is shown in FIGS. 13*a*, 13*b* and 14. In the example of FIGS. 13*a*, 13*b* and 14, a post 114 is extruded to define a channel 172. The channel 172 is located within the post 114 and is in communication with a slot 175. The channel 172 follows the shape of the post 114. Thus, in the illustrated example, the channel 172 is curved like the post 114. The enclosure 23 is joined to the post 114 by threading the corner bead 70 down into the channel 172 as shown in FIG. 13*a*. As shown in FIGS. 13*b* and 14, the enclosure 23 passes through the slot 175 when the bead is threaded into the channel 172. However, the slot 175 and the corner bead 70 are sized such that the corner bead 70 may not pass through the slot 175. Although the post 114 requires a more complicated manufacturing process than the post 14, the post 114 has the advantage of not requiring the track 74.

In order to provide a rigid, comfortable support for a child or infant located within the play yard 10, the play yard 10 is further provided with a floor board 90. When the illustrated play yard 10 is erected, the floor board 90 is located within the enclosure 23 on top of the lower frame 24 in a generally horizontal plane (assuming, of course, that the surface on which the play yard 10 is erected is generally horizontal). The illustrated floor board has a rounded rectangular outer perimeter substantially corresponding to the rounded rectangular shape of the upper frame 26. Since the lower frame 24 has a generally rectangular outer shape, portions of the floor board 90 extend outwardly of (i.e., overhang) the lower frame 24.

Other than its shape, the floor board 90 of the illustrated example is conventional. For example, the illustrated floor board 90 includes one or more foam pads secured to one or more boards. The pad(s) and board(s) are encased in a plastic sleeve as is conventional in portable play yards sold today such as the Travelin' Tot® play yards sold by Kolcraft Enterprises. Seams are defined between adjacent boards of the floor board 90 to facilitate folding of the floor board 90 in discrete sections. In the illustrated example, the floor board 90 includes four boards and is foldable in fourths. The floor board 90 may, thus, be wrapping around the collapsed play yard 10 for transport and/or storage.

The floor board 90 may be removably secured to the floor of the enclosure 23 by any suitable fasteners. In the illustrated example, the floor board 90 is secured to the floor of the enclosure 23 by Velcro® strips. Alternatively, the floor board 90 may be held in place by gravity without the benefit of fasteners.

Although certain example methods, apparatus and articles of manufacture have been described herein, the scope of coverage of this patent is not limited thereto. On the contrary, this patent covers all methods, apparatus and articles of manufacture fairly falling within the scope of the claims either literally or under the doctrine of equivalents.

What is claimed is:

1. A play yard comprising:

a collapsible upper frame;

a collapsible lower frame;

posts to support the upper frame above the lower frame, the posts including respective channels; and a foldable, frameless enclosure operatively coupled to the upper frame, the lower frame and the posts, the enclosure having a plurality of sides and a bottom to define an enclosure volume, the enclosure having a plurality of corner beads dimensioned for receipt in a respective one of the channels to secure the enclosure to the posts.

2. A play yard as defined in claim 1, wherein each of the posts includes a substantially exposed, outward facing surface.

3. A play yard as defined in claim 1, wherein the enclosure includes first sleeves dimensioned to receive the upper frame and second sleeves dimensioned to receive the lower frame.

4. A play yard as defined in claim 1, wherein at least a portion of each of the posts is curved.

5. A play yard as defined in claim 4, wherein the channels follow curvatures of the posts.

6. A play yard as defined in claim 1, wherein a first one of the sides and a second one of the sides extend from one of the channels in one of the posts, the first one of the sides extending in a first direction and the second one of the sides extending in a second direction different than the first direction.

7. A play yard comprising:

a frame movable between an erected position and a collapsed position, the frame including an upper frame and a lower frame;

a post positioned between the upper frame and the lower frame, the post having an inner portion including a channel; and a flexible enclosure having a first side, a second side and a bottom side, a corner bead threaded into the channel to couple the enclosure to the post.

8. A play yard as defined in claim 7, wherein the enclosure extends along the post between the upper frame and the lower frame.

9. A play yard as defined in claim 7, the post comprising a wall that defines an interior cavity and the channel separate from the interior cavity.

10. A play yard as defined in claim 7, wherein the first side and the second side extend from the channel, the first side extending in a first direction and the second side extending in a second direction different than the first direction.

11. A play yard comprising:

a collapsible upper frame;

a collapsible lower frame;

posts to support the upper frame above the lower frame, the posts defining respective channels; and a foldable, frameless enclosure operatively coupled to the upper frame, the lower frame and the posts, the enclosure having a plurality of sides and a bottom to define an enclosure volume, the enclosure having a plurality of corner beads dimensioned for receipt in a respective one of the channels to secure the enclosure to the posts.

12. A play yard as defined in claim 11, wherein the channels are integrally formed within respective ones of the posts.

13. A play yard as defined in claim 11, wherein a first one of the sides and a second one of the sides extend from one of the channels, the first one of the sides extending in a first direction and the second one of the sides extending in a second direction different than the first direction.

14. A play yard as defined in claim 11, wherein at least a portion of each of the posts is curved.

15. A play yard as defined in claim 14, wherein the channels follow respective curvatures of the posts.

16. A play yard as defined in claim 11, wherein each of the posts includes a substantially exposed, outward facing surface.

17. A play yard as defined in claim 11, each of the posts comprising a wall that defines an interior cavity and one of the channels separate from the interior cavity.

18. A play yard as defined in claim 11, wherein the enclosure includes first sleeves dimensioned to receive the upper frame and second sleeves dimensioned to receive the lower frame.

* * * * *